US005211288A

United States Patent [19]

Beall

[11] Patent Number: 5,211,288

[45] Date of Patent: May 18, 1993

[54] PORTABLE INTEGRATED DISPLAY SYSTEM

[76] Inventor: Joseph T. Beall, 1371 E. 8175 South, Sandy, Utah 84093

[21] Appl. No.: 805,082

[22] Filed: Dec. 11, 1991

[51] Int. Cl.[5] ..... B65D 69/00

[52] U.S. Cl. ..... 206/577; 206/223; 206/579; 190/109; 190/111

[58] Field of Search ..... 206/314, 315.1, 440, 206/570, 572, 573, 575, 576, 577, 579, 803, 223; 190/102, 107, 109, 111

[56] References Cited

U.S. PATENT DOCUMENTS

| | | | |
|---|---|---|---|
| 83,700 | 11/1868 | Durand | 206/573 |
| 1,223,161 | 4/1917 | Fazzini | 206/577 |
| 1,239,023 | 4/1917 | McElhinny | 206/577 |
| 1,849,565 | 3/1932 | Brady | 190/111 |
| 2,455,288 | 11/1948 | Alverez | 206/803 |
| 2,591,362 | 4/1952 | Kock | 206/577 |
| 2,742,956 | 4/1956 | Cannata | 206/577 |
| 2,850,156 | 9/1958 | Shane | 206/575 |
| 3,188,046 | 6/1965 | Cervenka | 206/314 |
| 3,542,019 | 11/1970 | Gittins | 206/440 |
| 3,589,507 | 6/1971 | Greenberg et al. | 206/47 R |
| 4,108,311 | 8/1978 | McClendon | 206/803 |
| 4,194,628 | 3/1980 | Campos | 206/570 |
| 4,334,612 | 6/1982 | Beato | 206/373 |
| 4,445,415 | 5/1984 | Izuierdo | 206/314 |
| 4,456,126 | 6/1984 | Hicks, Jr. | 206/803 |
| 4,471,873 | 9/1984 | Thomas | 206/573 |
| 4,606,625 | 8/1986 | Lombardi | 206/314 |
| 4,630,828 | 12/1986 | Lovin | 206/575 |
| 4,667,829 | 5/1987 | Edmund-White | 206/575 |
| 4,756,416 | 7/1988 | Johnson | 206/577 |
| 4,834,237 | 5/1989 | Henke et al. | 206/373 |
| 4,842,133 | 6/1989 | LaBarge et al. | 206/315.1 |
| 4,911,296 | 3/1990 | Hart, Jr. | 206/803 |
| 4,917,238 | 4/1990 | Schumacher | 206/223 |
| 5,018,609 | 5/1991 | Brenner | 206/225 |
| 5,072,832 | 12/1991 | Valentine et al. | 206/570 |

*Primary Examiner*—David T. Fidei
*Attorney, Agent, or Firm*—Madson & Metcalf

[57] ABSTRACT

A portable, integrated system for displaying products and services at a display booth is disclosed. The system comprises a carrying case which includes a plurality of compartments, a table cloth for substantially covering a display table in the display booth, a display easel which displays printed indicia when in an open position and which is insertable into one of the compartments of the carrying case when in a closed position, and a header display which includes a flexible header with printed indicia thereon. The header display further includes a header frame which surrounds and supports the header and to which the header is temporarily attached and a plurality of wire hooks for suspending the header frame and header from the framework of the display booth. Alternatively, when the display booth does not include a framework, the header frame and header may be suspended from a plurality of upright, free-standing poles. The system may further include a steamer for removing wrinkles from the table cloth and an upright, free-standing pole for use in the display.

21 Claims, 10 Drawing Sheets

PORTABLE INTEGRATED DISPLAY SYSTEM

BACKGROUND

1. The Field of the Invention

This invention relates generally to the display of products and services at trade shows and the like, and more specifically to a novel system, and related method, for packaging the contents of a display booth into a single, portable carrying case.

2. Technical Background

Many methods of advertising and marketing are known in the art. One method which has proven to be highly successful, particularly when new products or services or a new company is desired to be introduced within a certain industry, is the trade show. Hundreds of trade shows are conducted annually throughout the United States and the world. The industry trade show provides an opportunity for manufacturers and sellers of goods within a particular industry to display their goods. The trade show also provides the opportunity for buyers of specific types of goods to have access to multiple suppliers at one time and in one location.

Trade shows are typically held in a convention hall or arena. A typical trade show catering to a specific industry comprises a large open area which is physically separated into several booths, each booth being occupied by a vendor. Each booth is generally provided with a minimum of facilities. Such facilities may include a backdrop in the form of a curtain, which is supported by a rod or series of rods. Generally, each booth is also provided with a display table.

Businesses within or dealing with the subject industry are invited to observe and/or sample the products and services offered by the vendor. However, those displaying at a trade show must work with the minimal equipment provided in order to set up a display.

Businesses displaying at trade shows often base a significant percentage of their direct orders on contacts made at trade shows. Accordingly, vendors must be mindful not only that the goods and/or services which they offer are of the finest quality, but also that their booth presentation is appealing to the target buyer. Often, the amount of time, effort and money which is spent on the presentation of the a vendor's wares rivals that spent on the manufacturing of those same wares.

A problem is encountered, however, by vendors who are forced to travel to several different trade shows in different locations each year in order to contact enough potential customers to justify their economic existence. Such vendors are faced with providing an attractive display using very few resources provided by the trade show it self. This leaves the vendor with the task of providing a mobile display.

In this situation, cost restrictions generally prohibit building new display exhibits for each trade show. At the same time many displays are too cumbersome and heavy to package and ship from city to city. The quality of the presentation thereby suffers, thus diminishing the effectiveness of the vendor's efforts.

To applicant's knowledge, no system or method exists whereby a vendor can by design and in an organized fashion place all of the necessary components of a successful trade show booth other than a table-top display within a single "carry-able" integrated package to facilitate ease of travel and set-up. The useful elements include such items as table covers, display stands, signs, display graphics, and the like.

Accordingly, it would be a significant advancement in the art to provide a portable system, and corresponding method, whereby all necessary components for construction of a trade show display are provided within a single "carry-able" integrated package. It would be another advancement in the art to provide an organized approach to assembling and disassembling a trade show display.

It would be yet another advancement in the art to provide a containerized, integrated system for quickly assembling and disassembling a trade show booth. It would be another advancement in that art to provide a portable, light-weight carrying case, having small dimensions, which is easily shipped between locations, and which contains all the necessary components to a successful trade show booth. It would be another advancement in the art to provide a portable, integrated display system for trade shows which is inexpensive, easily manufactured, efficient, easily operated by one person, easily maintained, durable, and long lasting.

Such methods and apparatus are disclosed and claimed herein.

BRIEF DESCRIPTION AND OBJECTS OF THE INVENTION

The present invention comprises generally a portable, integrated system for displaying products and services at a trade show display booth, the display booth being furnished with a display table. In one embodiment, the system comprises a carrying case, a tablecloth, a display easel, and a header display.

The carrying case includes a plurality of compartments, the tablecloth, the display easel, and the header display each being insertable into one or more of the compartments of the carrying case. The table cloth is of a size to substantially cover the display table, and may bear the name and/or logo of the vendor. The display easel is movable between open and closed positions; the easel displaying printed indicia such as marketing information when in the open position, and being small enough to be insertable into one or more of the compartments of the carrying case when in a closed position. (Frame is assembled and disassembled—graphic is rolled up for storage.)

The header display includes a flexible header with printed indicia, the header being foldable for placement in one of the compartments of the carrying case; a frame surrounding and supporting the header to which the header may be temporarily attached; and means for supporting the frame in an elevated position readily accessible to the eye. The frame is disassemblable into individual component parts which are insertable into one of the compartments of the carrying case.

The means for supporting the frame in an elevated position may comprise a plurality of upright, free standing poles, each pole being movable between open and closed positions. In the open position, each pole includes a lower portion which comprises at least three stabilizing legs for maintaining the pole in an upright position, and an upper portion which comprises some means for attaching the frame to the pole. In the closed position, each pole is collapsed, folded, or disassembled to become insertable into one of the compartments of the carrying case.

The display booth space, which is not a part of but relates to this invention, often comprises a rigid framework defining the perimeter thereof. If this is the case, an alternative means for supporting the frame in an elevated position may be used. This alternative means may comprise a plurality of temporarily attachable wire hooks, each wire hook having a first curved end which can loop about the rigid framework and a second, oppositely-curved, end which can be inserted into an aperture along the top edge of the frame. Each wire hook is of a size so as to be insertable into one of the compartments of the carrying case.

The system may further include an upright, free-standing pole which is movable between open and closed positions. In the open position, the pole includes a lower portion which comprises at least three stabilizing legs for maintaining the pole in an upright position, and an upper portion which comprises a hook or some other means for hanging a display item. In one of the illustrated embodiments, the handing display item comprises an intravenous solution container. In the closed position, the pole is collapsed, folded, or disassembled, thereby becoming insertable into one of the compartments of the carrying case.

Any or all of the poles described above, whether used to suspend an intravenous solution container or as a means for supporting the frame in an elevated position, may include a temporarily attachable, ground-contacting foot for each stabilizing leg thereof. The feet add stability and therefore are for use when the pole is in the upright or open position. Each foot is detachable from or hinged to its stabilizing leg, and when detached therefrom, is insertable into one of the compartments of the carrying case.

As with the frame, the easel may be disassembled into individual component parts when in the closed position or alternatively may be folded or collapsed into the closed position. Advantageously, both the frame and the easel are assembled together by inserting the tongue of one component part into the groove of another component part. In this case, the component parts of the easel frame are best disassembled by use of a separation tool which separates the tongue of the one component part from the groove of the other component part in which the one is inserted.

The system may further include an electric steamer for removing wrinkles from the table cloth. Of course, the steamer is of a size and has characteristics so as to be insertable into one of the compartments of the carrying case.

Preferably, the carrying case comprises first and second halves, each including at least one compartment; a handle; and a zipper or similar means for temporarily securing the first and second halves together. At least some of the compartments of the carrying case include means for maintaining objects within the compartment, such as a strap which is attached to the carrying case, the strap being wrapped about the object to be maintained within the compartment, or, in the alternative, a cover which encloses the object within the compartment.

The separation tool for separating the tongue of a first component from the groove of a second component, mentioned above, preferably comprises first and second rigid, elongate members, and hinging means whereby the first and second members are connected together, and whereby the first and second members are made movable between a closed position and an open position. The first member has a separating end which forms an oblique angle with a gripping end, and the second member has a separating end which forms a right angle with a gripping end.

In the closed position, the two separating ends are flush against each other for insertion between the first and second components, while the gripping ends of the first and second members are separated. When opposing inward forces are imposed upon the respective gripping ends of the first and second members, the two separating ends are forced apart as the gripping ends of the first and second members are brought together (this constituting the open position), thereby forcing the first and second components apart. Preferably, the first and second rigid, elongate members are biased together in the closed position.

Advantageously, the hinging means for connecting the first and second rigid members together comprises a pivot arm, a slot disposed in the first member, and a pin rigidly mounted on the second member so as to slidably extend through the slot in the first member. The pivot arm is hingedly connected at one end to the first member and is hingedly connected at the other end to the rigid member.

In use, the invention is carried out by opening the carrying case, removing from one of the compartments the table cloth and draping the table cloth over the display table, removing from one of the compartments the various components of the header display and erecting the header display in an elevated position readily accessible to the eye, and removing the easel from one of the compartments and changing the easel into an open position such that printed indicia may be displayed thereon. The booth is disassembled by reversing this procedure.

Accordingly, a principal object of the present invention is the provision of a portable system, and corresponding method, whereby all necessary components for construction of a trade show display are provided within a single integrated package.

Another major object of this invention is to provide an organized approach to assembling and disassembling a trade show display.

Yet another important object of this invention is the provision of a containerized, integrated system for quickly assembling and disassembling a trade show display.

A further principal object of the present invention is to provide a portable, light-weight carrying case, having small dimensions, which is easily shipped between locations, and which contains all the necessary components to a successful trade show booth.

Still another significant object of the present invention is to provide a portable, integrated display system for trade shows which is inexpensive, easily manufactured efficient, easily operated by one person, easily maintained, durable, and long lasting.

These and other objects and advantages cf the invention will become more fully apparent from the description and claims which follow, or may be learned by the practice of the invention.

BRIEF DESCRIPTION OF THE DRAWINGS

In order that the above recited and other advantages and objects of the invention can be appreciated, a more specific description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity an detail through the use of the accompanying drawings, in which.

DETAILED DESCRIPTION OF THE PREFERRED EMBODIMENTS

Figure 1:
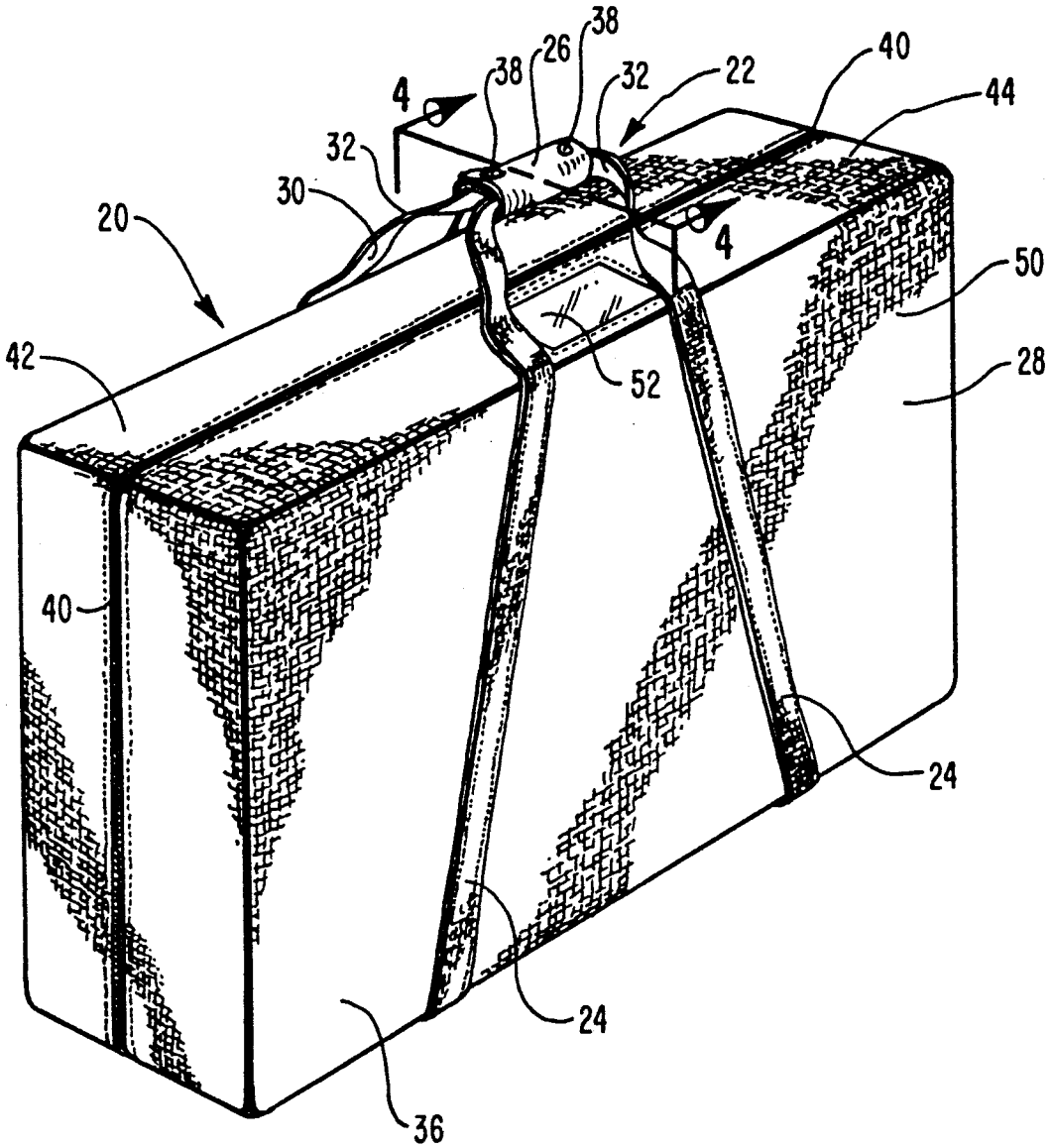
FIG. 1 is a perspective view of a presently preferred carrying case, according to the present invention, in which all necessary components of a trade show booth are contained.

Reference is now made to the drawings in which like components are designated with like reference numbers throughout. Referring first to FIGS. 1 through 4, the preferred carrying case 20 is illustrated. As shown, the carrying case 20 las a generally three dimensional rectangular shape and includes a handle 22, which facilitates ease of portability.

Although the preferred handle 22 comprises an elongated strap 24 and an encompassing grip 26, any number of standard handles well-known in the industry are contemplated and fall within the purview of this invention.

The illustrated handle 22, as mentioned, comprises the elongate strap 24, which may be a single piece of fabric formed into a single looped member. As illustrated, the strap 24 completely encompasses the case 20, the strap 24 being secured to the outer surface 28 of the case 20 by glue, stitching, or like means. Two end loops thereof, 30 and 32, are not attached to the carrying case 20 and extend loosely upwards from opposing broad faces 34 and 36, respectively, of the carrying case 20.

When closed, and when in transport, the end loops 30 and 32 are surrounded by the encompassing grip 26. The encompassing grip 26 is preferably formed of a single piece of fabric or leather which is formed around the end loops 30 and 32 of the strap 24 in the general shape of a cylinder. Advantageously, the encompassing grip 26 comprises velcro or snaps 38, or similar fasteners, to maintain the encompassing grip 26 in the cylindrical shape, thereby maintaining the end loops 30 and 32 of the strap 24 together in a closed position. Advantageously, the grip 26 is sewn or otherwise attached to one of the end loops 30 or 32.

Figure 2:
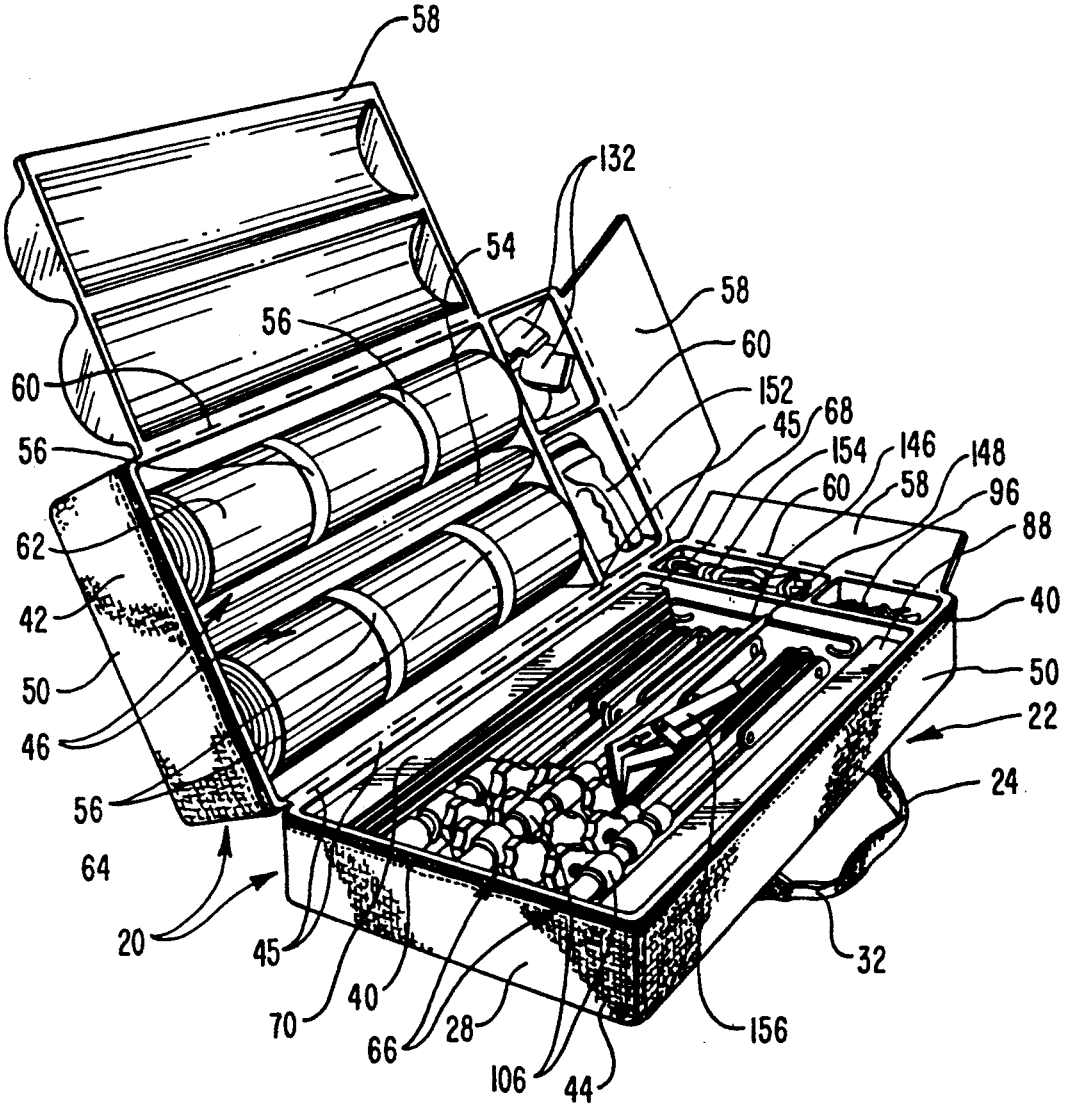
FIG. 2 is a perspective view of a first presently preferred embodiment of the present invention, illustrating the contents of the carrying case.
Figure 3:
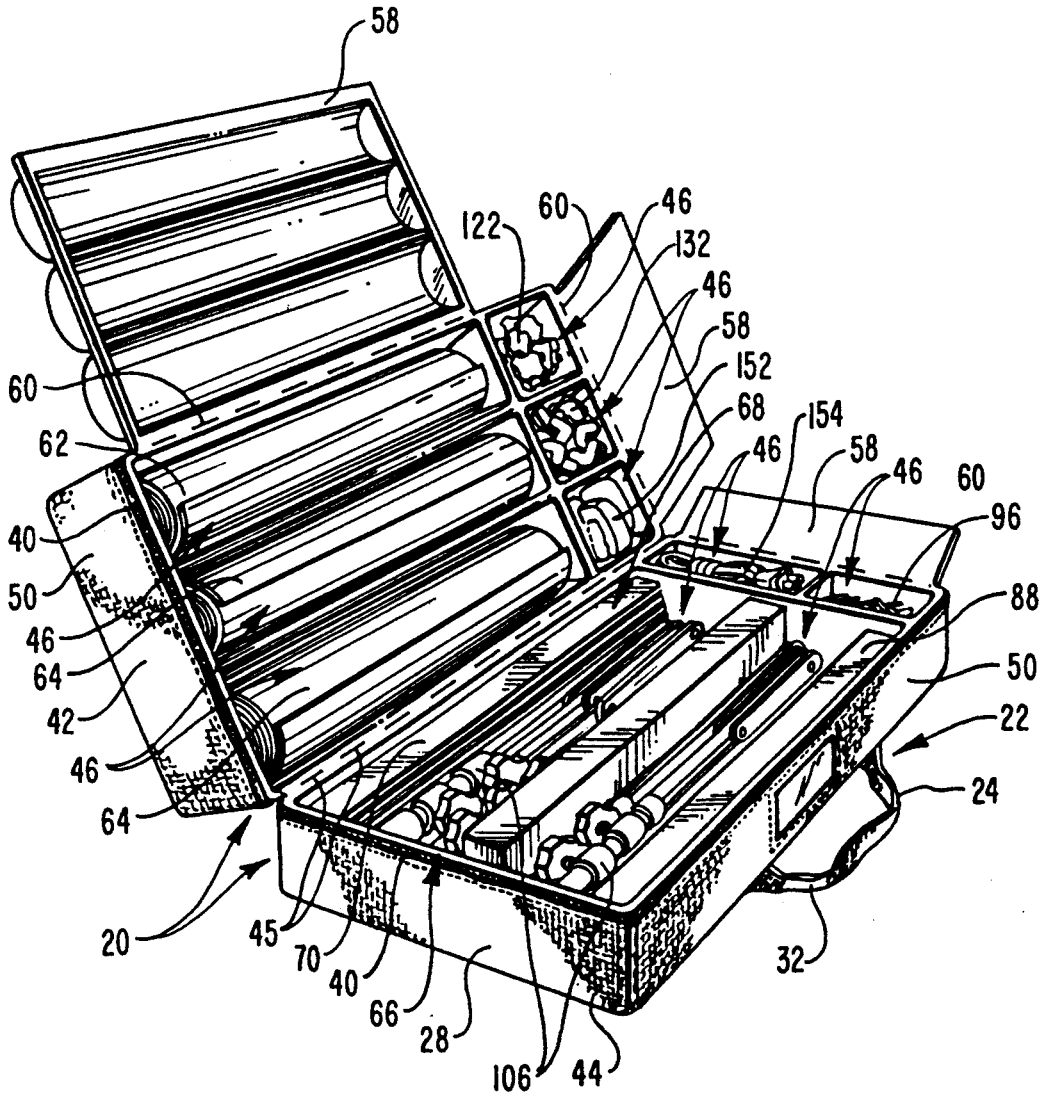
FIG. 3 is a perspective view of a second presently preferred embodiment of the present invention, also illustrating the contents of the carrying case.

When the carrying case 20 is to be opened, as shown in FIGS. 2 and 3, the velcro or snaps 38 are released, thereby releasing the end loops 30 and 32. Preferably, the carrying case 20 is maintained in a closed position not only by the end loops 30 and 32 in conjunction with the encompassing grip 26, but also with independent closing means as well. As illustrated, a zipper 40 may hold the carrying case 20 in a closed position, however, snaps or other similar fasteners may be substituted therefor.

FIGS. 1 through 4 further illustrate that the carrying case 20 comprises a first half 42 and a second half 44, both first and second halves 42 and 44, respectively, including at least one compartment 46, as hereafter explained in greater detail. Preferably, the two halves 42 and 44 are connected together along one edge by a continuous hinge 45, which allows pivotal opening and closing of the carrying case 20. One skilled in the art will recognize that the zipper 40 comprises means for temporarily securing the first and second halves 42 and 44, respectively, of the carrying case 20 together in a closed position.

As indicated, the carrying case 20 includes a plurality of compartments 46, wherein various components of the system of the present invention are conveniently stored. In order that each of the compartments 46 of the carrying case 20 maintain these components in a safe manner, the carrying case 20 is formed of either a rigid or a semi-rigid material. Wood, steel, polymer composites, and the like are all suitable materials out of which the carrying case 20 is constructed.

Advantageously, the carrying case 20 is encompassed about by a fabric cover 50 to which the strap 24 is attached, the fabric cover therefore comprising the outer surface 28 of the carrying case 20 to which the strap 24 is attached. The fabric cover 50 facilitates the use of the zipper 40, which assists in maintaining the first and second halves 42 and 44, respectively, of the carrying case 20 together in a closed position when in transport. A plastic window 52 may be sown onto the fabric cover 50 to allow insertion of an identification tag.

Figure 4:
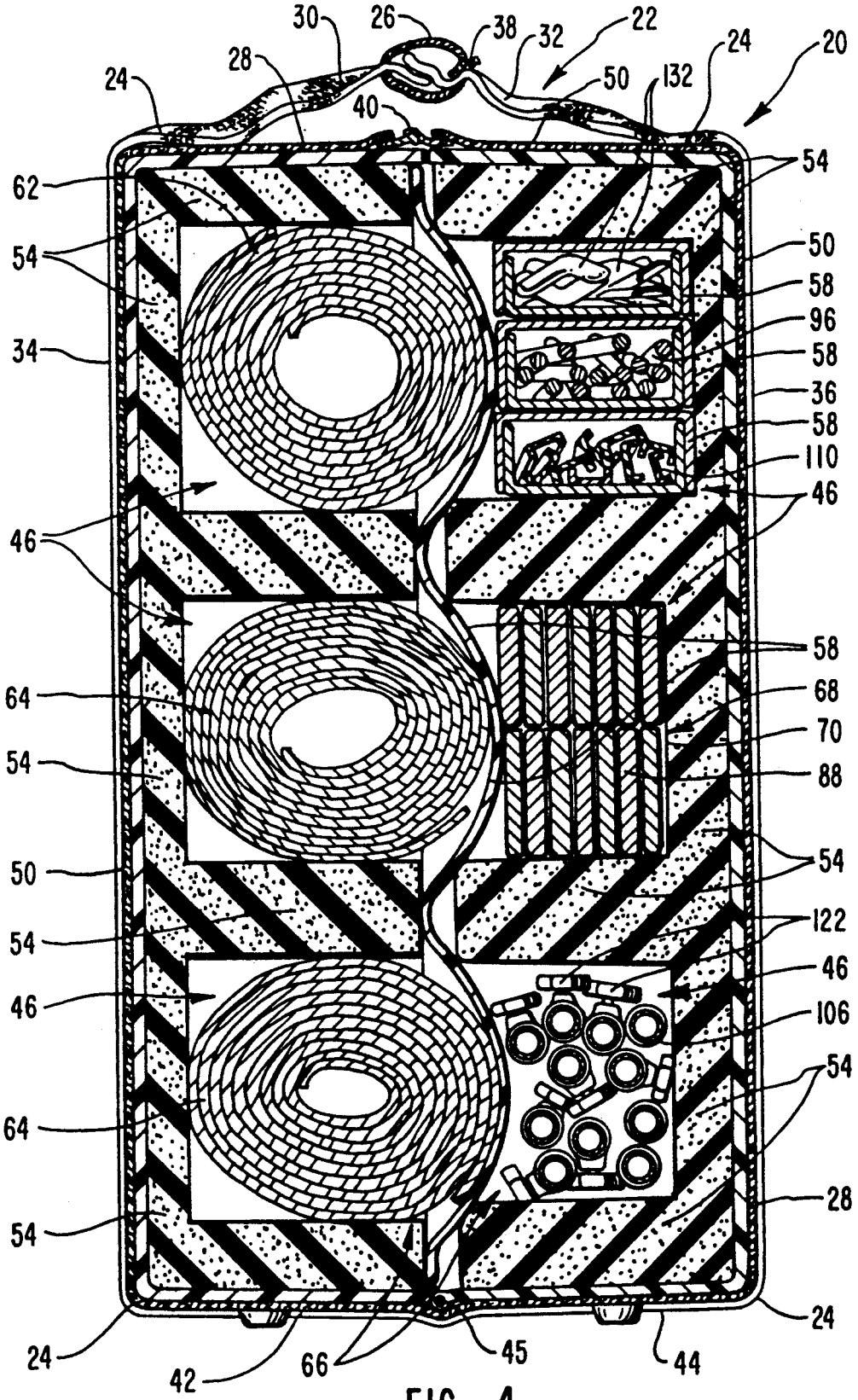
FIG. 4 is a partially cut-away, elevational view of a third presently preferred embodiment of the present invention, taken along the lines 4—4 of FIG. 1.

As best illustrated in FIG. 4, the compartments 46 within the carrying case 20 are defined by formed walls 54. The formed walls 54 may be inserts or may be integrally constructed within each of the halves 42 and 44 thereof, as shown. While desirably cushioned to prevent breakage of components contained therein, the formed walls 54 must also possess some structural integrity; therefore, a dense foam rubber or similar reticulated material is preferred.

One skilled in the art will appreciate that any variety of components used in a trade show exhibit booth may be stored within the compartments 46, and therefore the number and configuration of compartments 46 is variable dependent upon specific need. Two preferred configurations are illustrated, however, in the embodiments shown in FIGS. 2 and 3.

At least some of the compartments 46 of the carrying case 20 include means for maintaining or securing objects, such as system components, within the compartment 46. One such means is a plastic ring 56 which is not attached at one point to the carrying case 20. The ring 56 may be wrapped about the object to be maintained within the compartment 46.

Another preferred means for maintaining objects within the compartment 46 is a cover 58. See FIGS. 2 and 3. The cover 58 may be attached to the carrying case 20 by hinges 60 or by some other conventional means of attachment.

Preferably, the first half 42 of the carrying case 20 has compartments 46 which are configured to store a table cloth 62, as well as at least one header 64 which bears printed indicia thereon. Most display booths encountered at trade shows are already supplied with a display table 63, or a display table 63 is readily accessible, and thus the table cloth 62 becomes an important part of the system of the present invention.

The preferred table cloth 62 substantially covers the display table 63, the table cloth 62 being foldable for placement in one of the compartments 46 of the first half 42 of &he carrying case 20. Advantageously, the table cloth 62 bears the name and/or logo of the vendor who is using the system.

The header 64 is flexible and thus may le folded, or rolled, as shown, for placement in one of the compartments 46 of the first half 42 of the carrying case 20. The header 64 is an important part of the header display 66, described hereafter in greater detail.

The second half 44 of the carrying case 20 has compartments 46 which are designed to contain a display easel 68, as well as all components of the header display 66, excluding the header 64 itself. The display easel 68 is movable between open and closed positions, the closed position being shown in FIGS. 2 through 4, and alternative open positions being shown in FIGS. 5 and 6.

In the open position, the easel 68 displays printed indicia such as marketing information or advertising pictorials. In the closed position, the easel 68 is insertable into one of the compartments 46 of the second half 44 of the carrying case 20. While the easel 68 may be folded, or collapsed, into the closed position, it is presently preferred that the easel 68 be disassembled into individual component parts when in the closed position.

Figure 7:
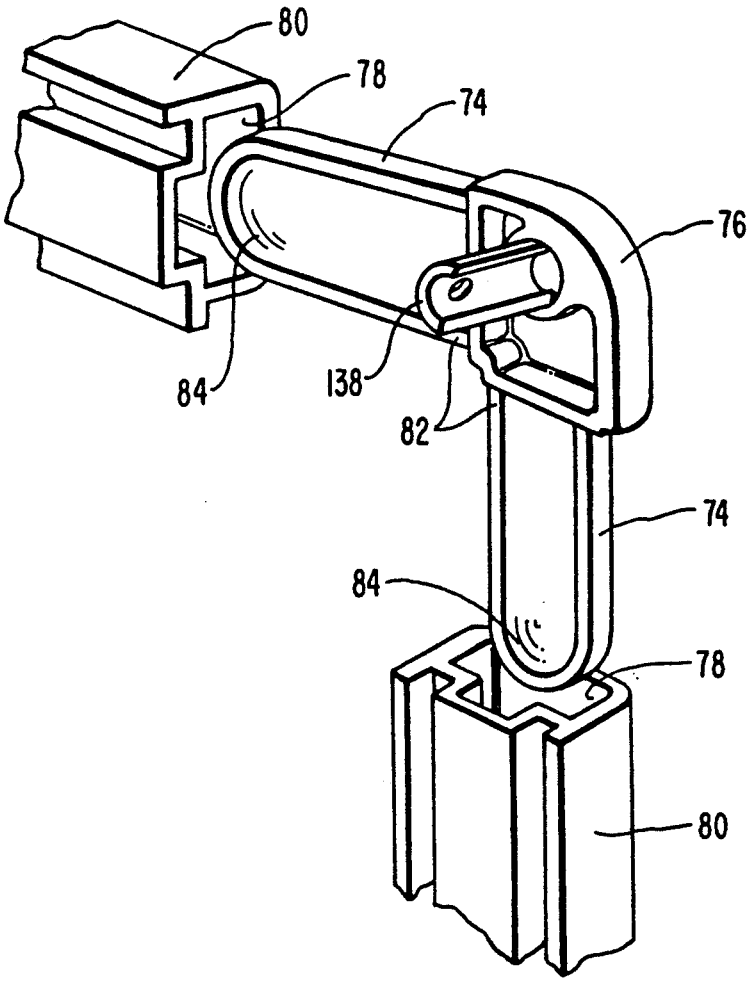
FIG. 7 is an enlarged, cut-away perspective view of a typical joint connecting components of the leader frame and the easel together.

Generally, the display easel 68 comprises an easel frame 70 and a bracket support, not shown. At present preference, the easel frame 70 is disassemblabled into individual component parts so as to more facilely fit into one of the compartments 46. These component parts are advantageously assembled together by inserting a tongue 74 of a first component 76 into a groove 78 of a second receiving component 80, as best illustrated in FIG. 7. Such tongue and grove frame construction is common in the industry and is available, for example, from MARK BRIC, Inc.

As illustrated in FIG. 7, each tongue 74 is received into a groove 78 simply by manually inserting the tongue 74 therein. Advantageously, each tongue 74 tapers from a proximate end 82 to a distal end 84 such that when a tongue 74 is completely inserted into a corresponding groove 78, a friction fit prevents dislodgment. Other detachable frame assemblies are exchangeable with that shown here and are thus included within the scope of this invention.

Figure 5:
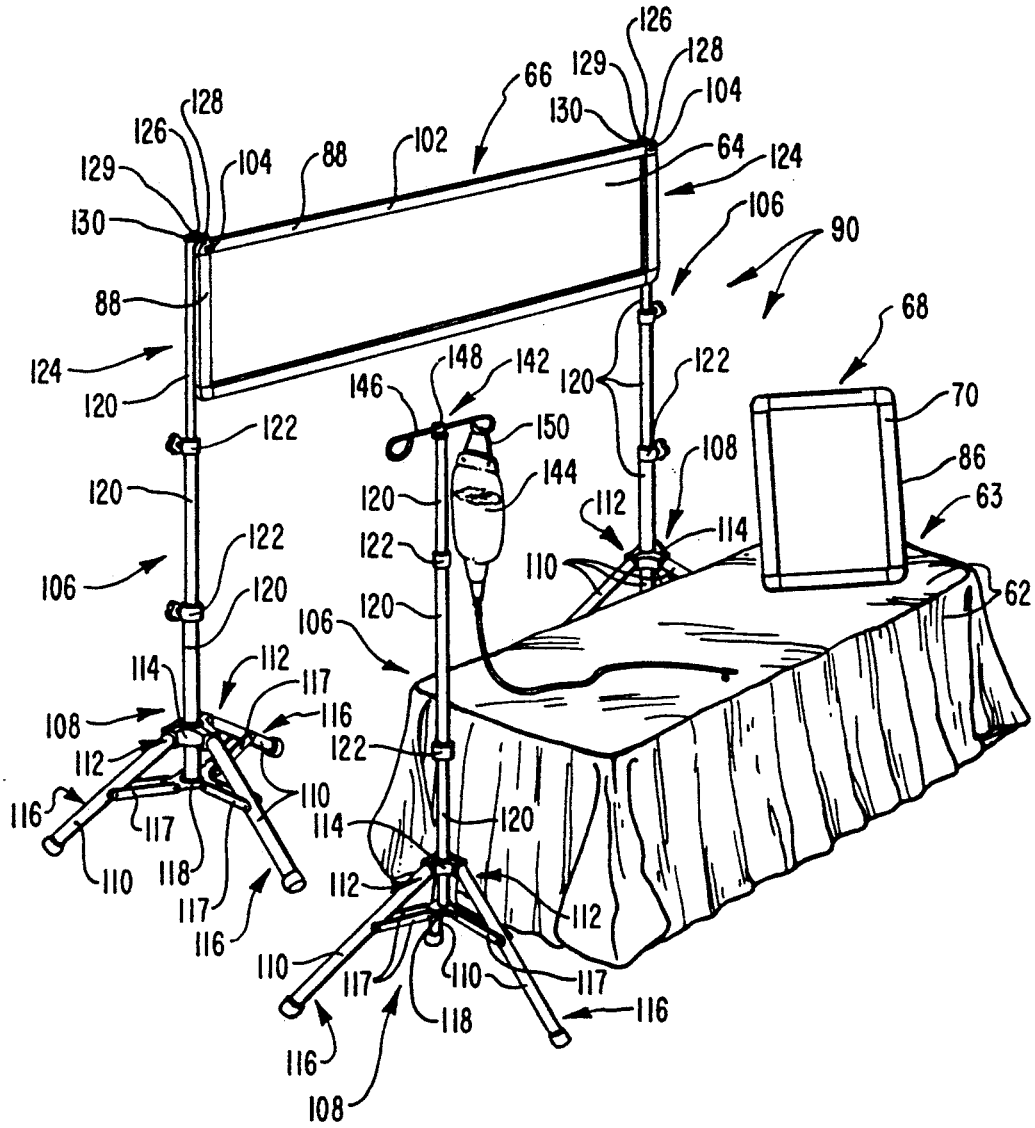
FIG. 5 is a perspective view of a trade show booth furnished according to the teachings of the present invention.
Figure 11A:
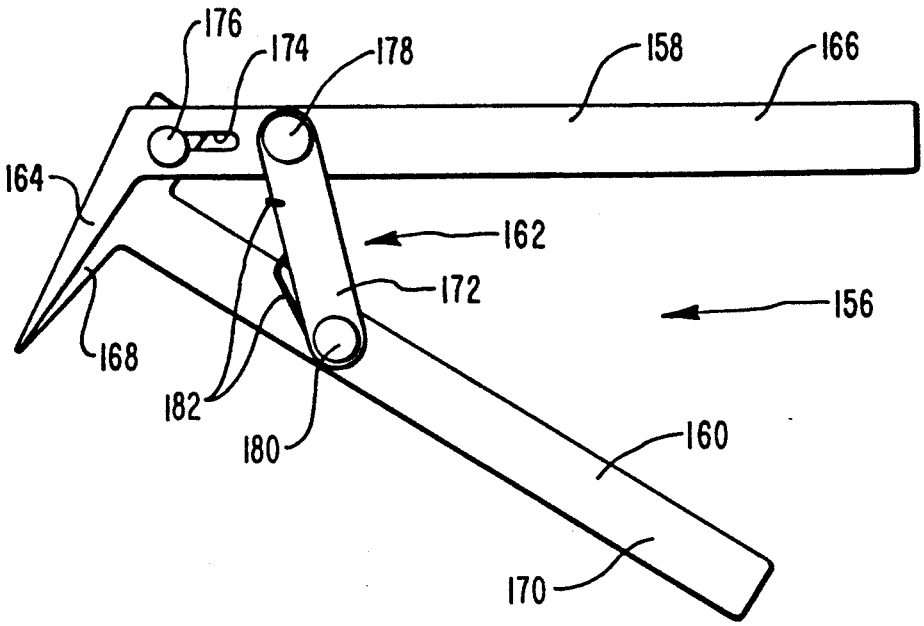
FIG. 11A is a front elevational view of a preferred separation tool, according to the principles of the present invention.
Figure 11B:
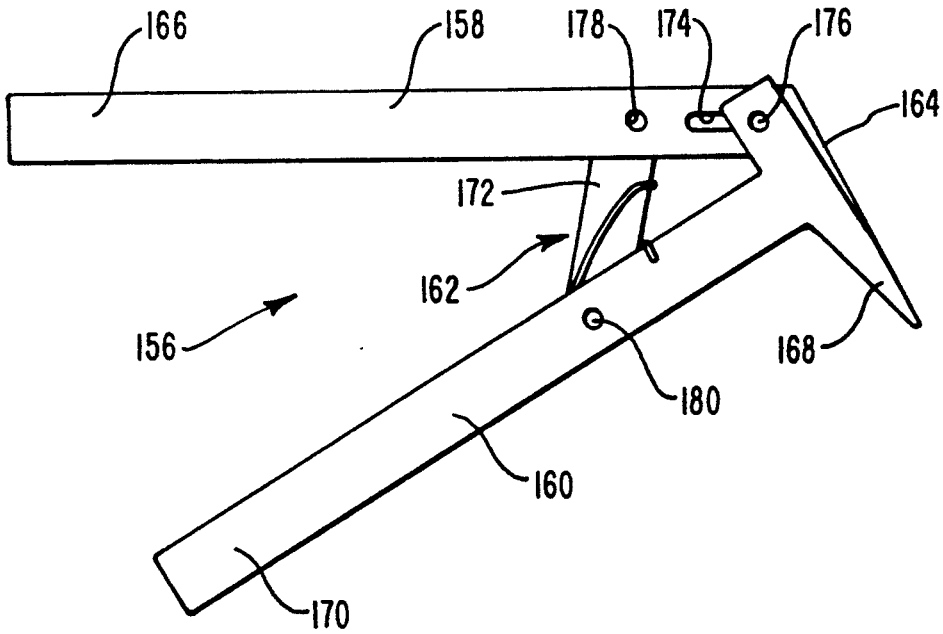
FIG. 11B is a rear elevational view of the separation tool of FIG. 11A.
Figure 11C:
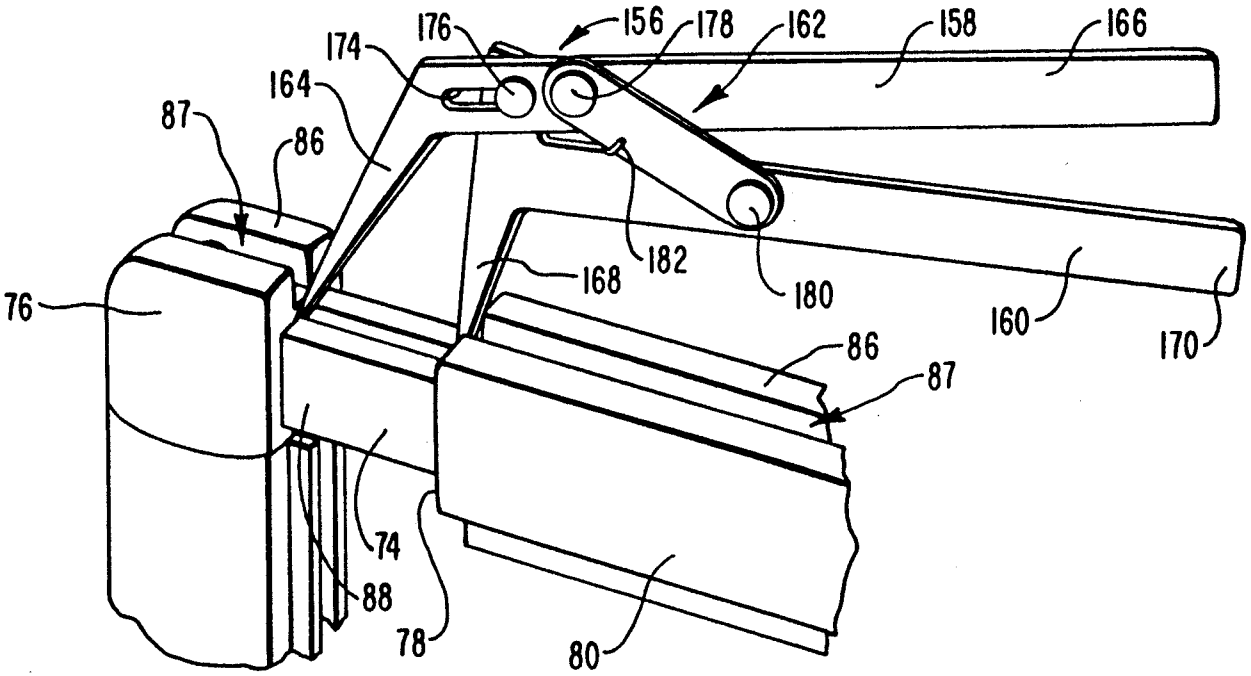
FIG. 11C is a partially cut-away, perspective view of the separation tool of FIG. 11A, as it is used to separate header frame or easel components.

The exterior edges 86 of the easel frame 70 preferably include a groove 87, shown only in FIG. 11C, into which leading edges, not shown, of the bracket support are inserted when in the open position. The bracket support is preferably a single length of wire, similar to a coat hanger, which has been bent so as to support the easel frame 70 in a substantially upright position, as shown in FIG. 5. While bendable into a desired shape, the bracket support, of course, must possess some structural integrity.

As illustrated in FIG. 5, the header display 66 comprises the flexible header 64 already mentioned, a header frame 88 which surrounds and supports the header 64 and to which the header 64 may be temporarily attached, and some means for supporting the header frame 88 in an elevated position readily accessible to the eye. The header frame 88 is preferably identical in all respects to the easel frame 70, and thus need not be described again. As such, the header frame 88 is disassemblable into individual component parts which are insertable into one of the compartments 46 in the second half 44 of the carrying case 20.

Figure 6:
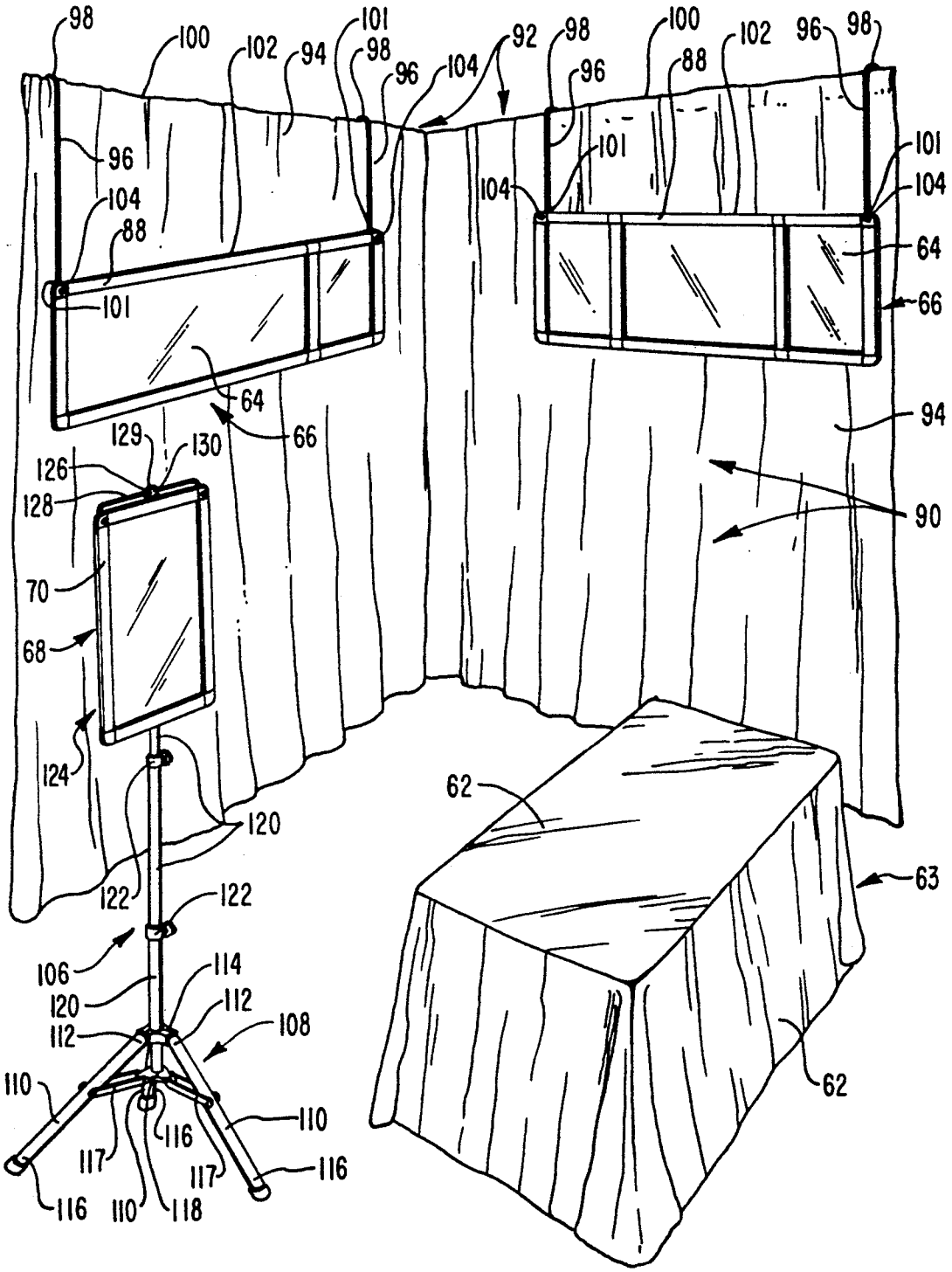
FIG. 6 is a perspective view of still another trade show booth furnished according the teachings of the present invention.

There are currently two preferred means for supporting the header frame 88 in an elevated position. As illustrated in FIG. 6, the first of these is used when the display booth 90 used with this invention includes a rigid framework 92 which defines the perimeter thereof. As best shown in FIG. 6, a display booth 90, which includes the framework 92, usually further includes drapes or curtains 94 to not only add aesthetic value thereto, but also to physically separate the various display booths 90.

In this embodiment, the means for supporting the header frame 88 in an elevated position comprises a plurality of temporarily attachable wire hooks 96. Still referring to FIG. 6, each wire hook 96 has a first curved end 98 which can loop about the rigid framework 92, usually about a top cross-member 100 thereof.

Each wire hook 96 also has a second link 101 designed to attach temporarily to the header frame 88 along its top edge 102. Preferably the top edge 102 of header frame 88 includes a plurality of apertures 104 disposed at spaced intervals, the second curved end or link 101 of each wire hook 96 being inserted into one of the apertures 104 along the top edge of the header frame 88. The wire hooks 96 must be of a size and shape so as to be insertable into one of the compartments 46 of the carrying case 20.

The second preferred means for supporting the header frame 88 in an elevated position is used when no frame work 92 is provided with the display booth 90, and is best shown in FIG. 5. This means comprises a plurality of upright, free-standing poles 106, each pole 106 being movable between open and closed positions. As illustrated, each pole 106 includes a lower portion 108, the lower portion 108 including at least three stabilizing legs 110 for maintaining the pole 106 in an upright position.

In the open position, the stabilizing legs 110 extend at an oblique angle radially outward from the pole 106, a proximal end 112 being attached to a collar 114 which moves slidably up and down the pole 106, and a distal end 116 usually contacting the floor or ground. Further, pivot arms 117 maintain the stabilizing legs 110 in the open position by being pivotally attached at one end to a stabilizing leg 110 near the mid-section thereof, and by being pivotally attached at the opposing end to the bottom end 118 of the pole 106. Such a configuration is well known and one skilled in the art will recognize it as a typical tripod assembly.

Advantageously, each pole 106 has a plurality of sections 120 which are telescoping to allow variation of the height at which the header frame 88 is displayed. In this manner, the header frame 88 is elevated to a position readily accessible to the eye. When the desired height at which the header frame 88 is to be displayed is obtained, standard screw locks 122 secure the various sections 120 in position.

In the open position, each pole 106 further comprises an upper portion 124 which includes means for attaching the header frame 88 to the pole 106. Preferably, the means for attaching the header frame 88 to the pole 106 comprises a swivel eyelet 126 which is attached at one end to a wire hook 128. The swivel eyelet 126 is rotatably attached at the other end to the top end 129 of each pole 106 by a swivel housing 130. See FIG. 10. The header frame 88 may be suspended from the wire hook 128 of each pole 106 in any conventional, well-known manner.

In the closed position, each pole 106 is insertable into one of compartments 46 of the second half 44 of the carrying case 20. The closed position is achieved by releasing each of the screw locks 122 to allow each of the sections 120 to be telescopically drawn within themselves. Further, the legs 110 are collapsed so as to be coaxial.

Figures 9, 10:
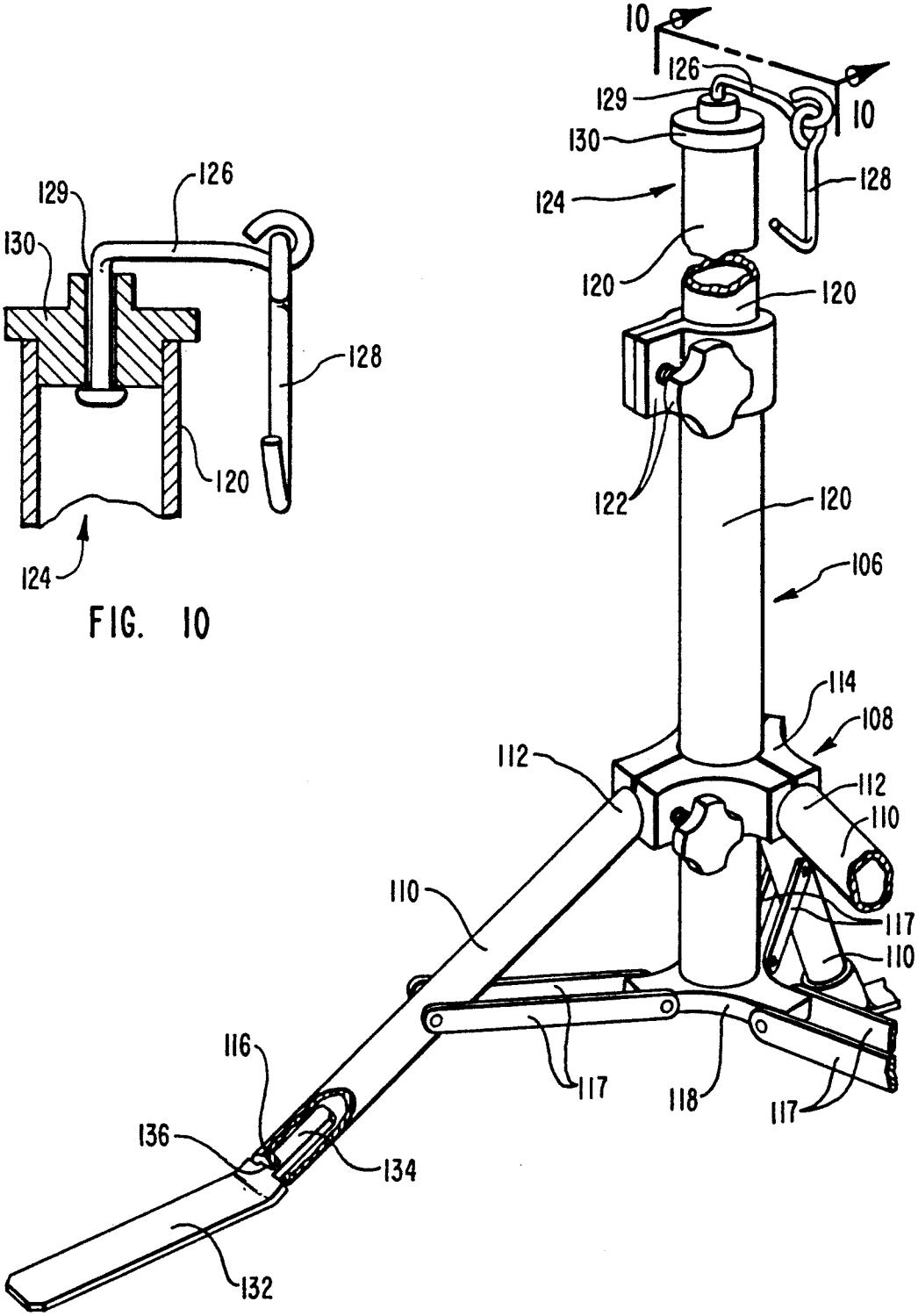
FIG. 9 is an enlarged, partially cut-away perspective view of a support pole, its stabilizing legs, and a stabilizing foot.
FIG. 10 is an enlarged, cut-away elevational view taken along the lines 10—10 of FIG. 9.

Referring now to FIG. 9, in which the details of each pole 106 are best illustrated, a temporarily attachable, ground-contacting foot 132 is shown. Each foot 132 adds stability to each pole 106 and is, of course, for use when the pole 106 is in the open position. Each foot 132 is of a size and shape so as to be insertable into one of the compartments 46 of the second half 44 of the carrying case 20 when not attached to a stabilizing leg 106.

Each foot 132 comprises a single piece of structural material having the general shape of a flat rectangular strip. One end of the foot 132 forms an angle which is oblique to the remainder thereof, this end forming a tab 134. As illustrated, the tab 134 of each foot 132 may be inserted into an aperture 136 in the open distal end 116 of a stabilizing leg 110 attached to a pole 106.

Figure 8:
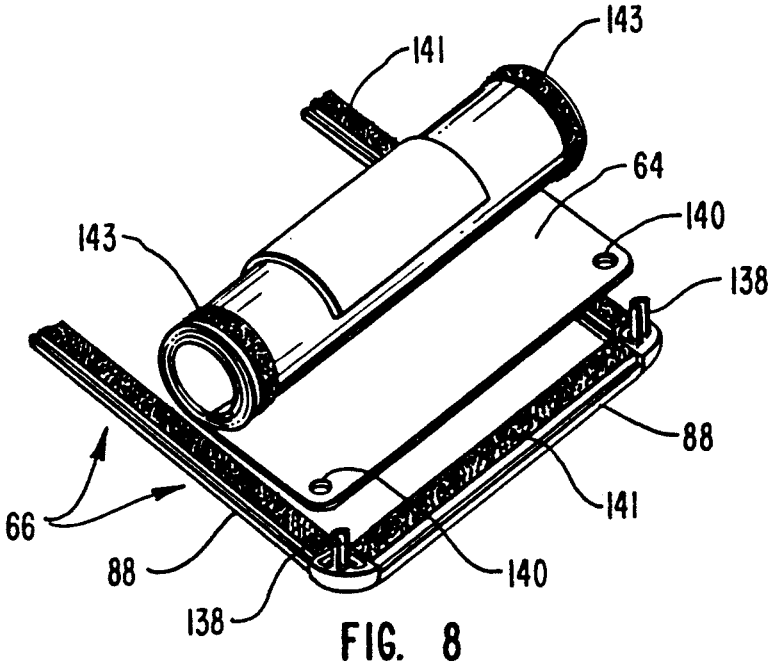
FIG. 8 is a partial perspective view of a preferred header display as it is being assembled.

FIG. 8 illustrates the header frame 88 as the header 64 is being attached thereto. As shown, the header frame 88 may include outwardly extending pins 138 which may be passed through apertures 140 in respective corners of the header 64. Corresponding hook and grabber strips 141 and 143 on the header frame 88 and the header 64, respectively, assist in maintaining the header 64 in the proper position within the header frame 88.

The system of the present invention may further include another pole 106, as illustrated in FIGS. 5 and 6. This separate upright, free-standing pole 106 is identical in virtually all respects as the pole 106 already described herein, and therefore need not be redescribed. However, slight modifications may be made to this pole 106, all of which will be described.

Referring first to FIG. 5, one of the poles 106 is shown to have an upper portion 142 which is somewhat different than the upper portion 124 already mentioned. The upper portion 142, rather than including the swivel eyelet 126, the wire hook 128, and the swivel housing 130, includes means for hanging an intravenous solution container 144 or other display item, from the pole 106 when in the open position.

The preferred means for hanging the container 144, as shown, comprises a rod 146, and a rod holder 148 which is attached securely to the top end of the pole 106. Advantageously, both ends of the rod 146 are bent into a looped position such that the intravenous solution container 144 can be suspended therefrom by a loop 150. The intravenous solution container 144 is preferably used in conjunction with an exhibit displaying medically related products and/or services. Other uses therefor, however, are contemplated.

Referring now to FIG. 6, an independent upright, freestanding pole 106 is used to display the easel frame 70 described above. This contemplated use of the pole 106 requires no modifications. All of the poles 106 shown in FIGS. 5 and 6 are insertable into one of the compartments 46 of the second half 44 of the carrying case 20 when in a closed position.

Referring again to FIGS. 2 and 3, the system of the present invention may include an electric steamer 152 for removing wrinkles from the table cloth 62. The steamer 152 is, of course, insertable into one of the compartments 46 of the carrying case 20. An electric cord 154, if necessary, may be included to provide power to the steamer 152.

When disassembling the component parts of the easel frame 70, a separation tool 156, illustrated in FIGS. 11A, 11B, and 11C, is advantageously used. The separation tool 156 is inserted when in the closed position, see FIGS. 11A and 11B, between attached component parts, whereupon opposing inward forces are exerted to bring the separation tool 156 into an open position, FIG. 11C, thereby extricating the tongue 74 of the first component 76 from the groove 78 of the second component 80.

The separation tool 156 is, of course, insertable into one of the compartments 46 of the carrying case 20, as illustrated in FIG. 2, the tool 156 comprising first and second rigid, elongate members 158 and 160, respectively, and a hinging assembly 162 whereby the first and second members 158 and 160 are connected together and whereby the first and second members 158 and 160 are made movable between a closed position and an open position.

The first member 158 has a separating end 164 and a gripping end 166, the separating end 164 forming an oblique angle with the gripping end 166. The second member 160 also has a separating end 168 and a gripping end 170, the separating end 168 forming a right angle with the gripping end 170.

Preferably, the hinging assembly 162 comprises a pivot arm 172, a slot 174 disposed in the first member 158, and a slot pin 176 which is rigidly mounted on the second member 160 so as to slidably extend through the slot 174 in the first member 158.

As shown, the pivot arm 172 is hingedly connected at one end to the first member 158 by a connecting pin 178, the opposing end of the pivot arm 172 being hingedly connected to the second member 160 by a second connecting pin 180. One skilled in the art will recognize that the hinging assembly 162 comprises hinging means which are preferred but not mandatory to the present invention. Other hinging means accomplishing the functions outlined above are also contemplated and fall within the scope of this invention.

In the closed position, the two separating ends 164 and 168 of the first member 158 and the second member 168, respectively, are flush against each other for insertion between the first and second components 76 and 80, respectively, while the gripping ends 166 and 170 of the first and second members 158 and 160, respectively, are separated.

When opposing inward forces are imposed upon the respective gripping ends 166 and 170 of the first and second members 158 and 160, the two separating ends 164 and 168 are forced apart while the gripping ends 166 and 170 are brought together into the open position, thereby forcing the first and second components 76 and 80, respectively, apart. In this manner, the header frame 88 and the easel frame 70 are easily disassembled for placement within the carrying case.

Advantageously, the first member 158 and the second member 160 of the separation tool 156 are biased together in the closed position by a wire spring 182 which is attached at one end to the connecting pin 180 of the second member 160 and bent about the pivot arm 172 so as to maintain the separating ends 164 and 168 in a position flush against each other.

In this position, the closed position, the slot pin 176 is disposed forwardly in the slot 174. When the members 158 and 160 are brought into the open position, the slot pin 176 is disposed rearwardly in the slot 174, thus facilitating separation of the separating ends 164 and 168 of the first and second members 158 and 160, respectively.

In use, the system is operated by opening the closed carrying case 20 by releasing the encompassing grip 26, separating the end loops 30 and 32 of the strap 24, and unzipping the zipper 40 which has maintained the carrying case 20 in a closed position. The two halves 42 and 44 of the carrying case 20 are then separated except for the hinge 45 which connects the two halves 42 and 44 together. In this position, the table cloth 62 may be removed from one of the compartments 46 of the carrying case 20 and draped over the display table 63.

The component parts of the easel frame 70 and its bracket support, which are in the closed position, are then removed, the easel 68 then being changed or erected into the open position such that printed indicia may be displayed thereon.

Next, the header display 66 is removed from the compartments 46 in which it is stored, the header display 66 being erected by assembling the header frame 88 components, attaching the header 64 thereto as shown in FIG. 8, and disposing the header display 66 on the poles 106 or on the frame work 92 of the display booth 90 by using the wire hooks 96.

The other components of the system such as the intravenous solution container 144 and the steamer 152 may be used as needed. The system of the present invention is disassembled and returned to the carrying case 20 by simply reversing the procedure mentioned above.

The invention may be embodied in other specific forms without departure from the spirit or essential characteristics thereof. The present embodiments are, therefore, to be considered in all respects as illustrative and not restrictive, the scope of the invention being indicated by the appended claims rather than by the foregoing description, and all changes which come within the meaning and range of equivalents of the claims are therefore to be embraced therein.

What is claimed and desired to be secured by United States Letters Patent is:

1. A portable, integrated display system for use in providing a display within a display booth comprising:
   - a portable carrying case;
   - means contained within said carrying case for dividing the interior of the carrying case into a plurality of compartments of substantially fixed shape;
   - a display easel comprising an easel frame and a plurality of collapsible legs, said display easel being movable between open and closed positions, the display easel being capable of displaying printed indicia when in the open position, and being insertable into one of the compartments of the carrying case when in the closed position; and
   - header display means including a flexible header with printed indicia, a header frame surrounding and supporting the flexible header to which the header may be temporarily attached, the header being foldable for placement in one of the compartments of the carrying case.

2. A system according to claim 1, further including an upright, free-standing pole being movable between open and closed positions, the pole having a lower portion including at least three stabilizing legs for maintaining the pole in an upright position and an upper portion including means for hanging a display item from the pole when in the open position, and the pole being insertable into one of the compartments of the carrying case when in the closed position.

3. A system according to claim 2, wherein each of the stabilizing legs includes a temporarily attachable, ground-contacting foot for added stability for use when the pole is in the open position, each foot being insertable into one of the compartments of the carrying case when not attached to a stabilizing leg.

4. A system according to claim 1, further including means for supporting the header frame in an elevated position readily accessible to the eye.

5. A system according to claim 1, wherein the easel is disassembled into individual component parts when in the closed position, the easel comprises an easel frame which is disassemblable into individual component parts and a bracket support, and the header frame and the easel frame are assembled together by inserting the tongue of one component part into the groove of another component part.

6. A system according to claim 5, wherein the component parts of the header frame and the easel frame are disassembled by use of a separation tool which separates the tongue of the one component part from the groove of the other component part in which the one is inserted.

7. A system according to claim 1, wherein at least some of the compartments of the carrying case include means for maintaining objects within the compartment.

8. A portable, integrated system for displaying products and services at a pre-existing display booth which booth includes a display table, the system comprising:
   - a carrying case including a plurality of compartments;
   - a tablecloth for substantially covering the display table, the tablecloth being foldable for placement in one of the compartments of the carrying case;
   - a display easel being movable between open and closed positions, the easel being capable of displaying printed indicia when in the open position and being insertable into one of the compartments of the carrying case when in the closed position; and
   - header display means including a flexible header with printed indicia, the header being foldable for placement in one of the compartments of the carrying case.

9. A system according to claim 8, further including an upright, free-standing pole being movable between open and closed positions, the pole having a lower portion including at least three stablizing legs for maintaining the pole in an upright position and an upper portion including means for hanging a display item from the pole when in the open position, and the pole being insertable into one of the compartments of the carrying case when in the closed position.

10. A system according to claim 9, wherein each of the stabilizing legs includes a temporarily attachable, ground-contacting foot for added stability for use when the pole is in the open position, each foot being insertable into one of the compartments of the carrying case when not attached to a stabilizing leg.

11. A system according to claim 8, wherein the header display means further includes a header frame surrounding and supporting the header and to which the header may be temporarily attached, the header frame being disassemblable into individual component parts which are insertable into one of the compartments of the carrying case.

12. A system according to claim 11, further including means for supporting the header frame in an elevated position readily accessible to the eye.

13. A system according to claim 12, wherein the means for supporting the header frame in an elevated position comprises a plurality of upright, free-standing poles, each pole being movable between open and closed positions, and each pole having a lower portion including at least three stabilizing legs for maintaining the pole in an upright position and an upper portion including means for attaching the header frame to the pole when in the open position, and each pole being insertable into one of the compartments of the carrying case when in the closed position.

14. A system according to claim 13, wherein each of the stabilizing legs of each of the poles includes a temporarily attachable, ground-contacting foot for added stability for use when the pole is in the open position, each foot being insertable into one of the compartments of the carrying case when not attached to a stabilizing leg.

15. A system according to claim 12, wherein the display booth further comprises a rigid framework defining the perimeter thereof, the header frame includes a top edge and a plurality of apertures disposed at spaced intervals along the top edge, and the means for supporting the header frame in an elevated position comprises a plurality of temporarily attachable wire hooks, each wire hook having a first curved end which can loop about the rigid framework and a second, oppositely-curved, end which can be inserted into one of the apertures along the top edge of the header frame, each wire hook being insertable into one of the compartments of the carrying case.

16. A system according to claim 11, wherein the easel is disassembled into individual component parts when in the closed position, the easel comprises an easel frame which is disassemblable into individual component parts and a bracket support, and the header frame and the easel frame are assembled together by inserting the tongue of one component part into the groove of another component part.

17. A system according to claim 16, wherein the component parts of the header frame and the easel frame are disassembled by use of a separation tool which separates the tongue of the one component part from the groove of the other component part in which the one is inserted.

18. A system according to claim 8, further comprising an electric steamer for removing wrinkles from the tablecloth, the steamer being insertable into one of the compartments of the carrying case.

19. A system according to claim 8, wherein at least some of the compartments of the carrying case include means for maintaining objects within the compartment.

20. A system according to claim 19, wherein the means for maintaining objects within the compartment is a cover which encloses the object within the compartment.

21. A system according to claim 8, wherein the carrying case comprises first and second halves, both first and second halves including at least one compartment; a handle; and means for temporarily securing the first and second halves together.

* * * * *